US007107806B2

(12) United States Patent
Tsuritani

(10) Patent No.: US 7,107,806 B2
(45) Date of Patent: Sep. 19, 2006

(54) SPRING MANUFACTURING MACHINE

(75) Inventor: Katsuhide Tsuritani, Osaka (JP)

(73) Assignee: Shinko Machinery Co., Ltd., Osaka (JP)

( * ) Notice: Subject to any disclaimer, the term of this patent is extended or adjusted under 35 U.S.C. 154(b) by 245 days.

(21) Appl. No.: 10/756,301

(22) Filed: Jan. 14, 2004

(65) Prior Publication Data

US 2004/0154365 A1 Aug. 12, 2004

(30) Foreign Application Priority Data

Feb. 10, 2003 (JP) ..... 2003-031809

(51) Int. Cl.
*B21F 3/10* (2006.01)

(52) U.S. Cl. ..... 72/138; 72/135; 72/142; 72/144

(58) Field of Classification Search ..... 72/135–145, 72/138, 144, 142
See application file for complete search history.

(56) References Cited

U.S. PATENT DOCUMENTS 5,363,691 A * 11/1994 Gallagher ..... 73/32 A
5,839,312 A * 11/1998 Itaya ..... 72/142
6,000,265 A * 12/1999 Itaya ..... 72/138

FOREIGN PATENT DOCUMENTS

| | | |
|---|---|---|
| JP | 6-2296 | 1/1994 |
| JP | 2000-061736 | 2/2000 |
| JP | 2000-197940 | 7/2000 |
| JP | 2002-120034 | 4/2002 |

* cited by examiner

*Primary Examiner*—Derris H. Banks
*Assistant Examiner*—Teresa M. Bonk
(74) *Attorney, Agent, or Firm*—Rabin & Berdo, PC

(57) ABSTRACT

In order that a moving locus of a leading end of a tool 55 provided to a tool mounting device 54 is aligned with a direction orthogonal to a center line W of a wire rod passage (not shown) of a final wire rod guide 13, a tool operating apparatus 22 has a position adjusting table 23 movable forward and backward and movable to optional positions within a virtual vertical plane parallel to a front wall 5 of an upper portion 2B of a fixed machine casing 2, a rotating body 46 provided to the position adjusting table 23 rotatably around a rotation center line C parallel to the center line W of the wire rod passage of the final wire rod guide 13, and a tool mounting device 54 provided in the rotating body 46 movably in parallel in a direction orthogonal to the rotation center line C.

4 Claims, 5 Drawing Sheets

SPRING MANUFACTURING MACHINE

BACKGROUND OF THE INVENTION

1. Field of the Invention

The present invention relates to a spring manufacturing machine.

2. Description of the Conventional Art

In conventional, as this kind of spring manufacturing machine, the following structure has been known.

There has been known a spring manufacturing machine which delivers a wire rod to a wire rod processing space from a final wire rod guide, and applies a predetermined process to the wire rod which was delivered or is being delivered to the wire rod processing space by a tool which will protrude or is in a protruding state to the wire rod processing space so as to manufacture a spring, wherein a tool operating apparatus is provided in such a manner as to oppose to the final wire rod guide beyond the wire rod processing space, and the tool operating apparatus has a position adjusting table provided so as to freely move forward and backward with respect to the final wire rod guide, a rotating body provided so as to freely rotate around a rotation center line arranged in alignment with a center line of a wire rod passage of the final wire rod guide in the position adjusting table, and a tool mounting device provided so as to freely oscillate along a virtual plane including the rotation center line, in the rotating body (refer to Japanese Patent Publication No. 6-2296).

The conventional spring manufacturing machine has the following defects.

Since the tool mounting device is provided in the rotating body so as to freely oscillate, a moving locus of a leading end (a leading end opposing to the final wire rod guide) of the tool provided in the tool mounting device forms a circular arc, by moving the tool mounting device from a retracted position to a working position, so that it is hard to execute a position control for stopping the leading end of the tool at a set position with respect to an outlet of the final wire rod guide. Further, in the case that a play exists in a power transmission link mechanism of the tool mounting device, the leading end position of the tool is displaced from the set position. However, since the position displacement appears as a displacement in a direction orthogonal to the center line of the wire rod passage of the final wire rod guide, and a displacement in a direction parallel to the center line of the wire rod passage of the final wire rod guide, there is a defect that the position displacement greatly lowers accuracy of form of the spring.

SUMMARY OF THE INVENTION

In order to solve the defect mentioned above, the present invention employs the following means.

(1) In accordance with a first aspect of the present invention, there is provided a spring manufacturing machine which delivers a wire rod to a wire rod processing space from a final wire rod guide, and applies a predetermined process to the wire rod which was delivered or is being delivered to the wire rod processing space by a tool, which is in a protruding or protruded state, to the wire rod processing space so as to manufacture a spring, wherein a tool operating apparatus is provided in such a manner as to oppose to the final wire rod guide beyond the wire rod processing space, and the tool operating apparatus has a position adjusting table provided so as to freely move forward and backward with respect to the final wire rod guide, a rotating body provided so as to freely rotate around a rotation center line arranged in alignment with a center line of a wire rod passage of the final wire rod guide, to the position adjusting table, and a tool mounting device provided so as to freely move in parallel to a direction orthogonal to the rotation center line, in the rotating body.

(2) In accordance with a second aspect of the present invention, there is provided a spring manufacturing machine which delivers a wire rod to a wire rod processing space from a final wire rod guide having a wire rod passage arranged in parallel to a vertical front wall of a fixed machine casing, and applies a predetermined process to the wire rod which was delivered or is being delivered to the wire rod processing space by a tool which is in a protruding or protruded state to the wire rod processing space so as to manufacture a spring, wherein a tool operating apparatus is provided in such a manner as to oppose to the final wire rod guide beyond the wire rod processing space, and the tool operating apparatus has a position adjusting table provided so as to freely move forward and backward and freely move to an optional position within a virtual vertical plane which is in parallel to the front wall of the fixed machine casing, a rotating body provided so as to freely rotate around a rotation center line arranged in parallel to a center line of the wire rod passage of the final wire rod guide, to the position adjusting table, and a tool mounting device provided so as to freely move in parallel to a direction orthogonal to the rotation center line, in the rotating body.

(3) In accordance with a third aspect of the present invention, there is provided a spring manufacturing machine wherein a wire rod delivering unit is provided in such a manner as to freely move forward and backward, to a fixed machine casing having a vertical front wall, in front of which a wire rod processing space is formed, the wire rod delivering unit has a final wire rod guide having a forward and backward moving body including a vertical front wall and a wire rod passage for guiding the wire rod delivered toward the wire rod processing space, and provided on the front wall of the forward and backward moving body in such a manner as to make the wire rod passage parallel to the front wall of the forward and backward moving body, and at least a pair of wire rod delivering rollers rotatably provided on the front wall of the forward and backward moving body and delivering the wire rod toward the final wire rod guide while clamping the wire rod, a tool operating apparatus is provided to the fixed machine casing in such a manner as to oppose to the final wire rod guide beyond the wire rod processing space, and the tool operating apparatus has a position adjusting table provided so as to freely move to an optional position within a virtual vertical plane which is in parallel to the front wall of the fixed machine casing, a rotating body provided so as to freely rotate around a rotation center line arranged in parallel to a center line of the wire rod passage of the final wire rod guide, to the position adjusting table, and a tool mounting device provided so as to freely move in parallel to a direction orthogonal to the rotation center line, to the rotating body.

(4) In accordance with a fourth aspect of the present invention, there is provided a spring manufacturing machine as recited in the third aspect, wherein the position adjusting table is provided so as to freely move forward and backward.

In accordance with the structure mentioned above, the present invention can achieve the following effect.

In accordance with each of the inventions as described in the first aspect to the fourth aspect, since the tool mounting device is provided to the rotating body in such a manner as to freely move in parallel to the direction orthogonal to the rotation center line, the moving locus of the leading end (the leading end opposing to the final wire rod guide) of the tool provided to the tool mounting device is aligned with the direction orthogonal to the center line of the wire rod passage in the final wire rod guide, in other words, does not form the circular arc as is different from the conventional structure. Accordingly, it is easy to execute the position control for stopping the leading end of the tool at the set position. Further, the displacement of the final wire rod guide is not generated in the parallel direction to the center line of the wire rod passage, only by preventing the play from being generated in the mechanism for guiding the tool mounting device so as to freely move in parallel. Accordingly, even when the leading end position of the tool is displaced from the set position, accuracy of a form of the spring is lowered at a small level due to the position displacement, in comparison with the conventional structure.

DESCRIPTION OF THE PREFERRED EMBODIMENT

Figure 1:
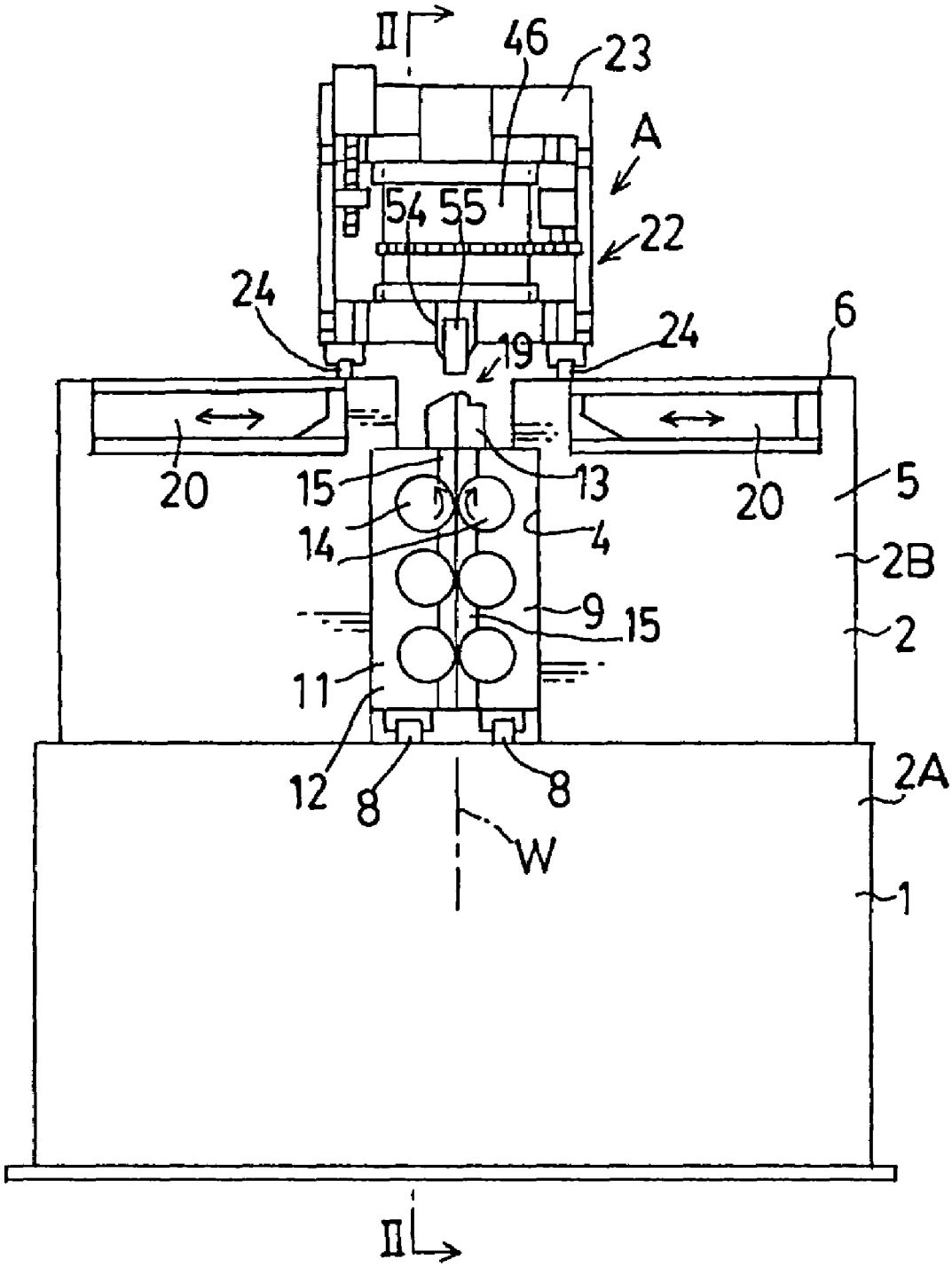
FIG. 1 is a front view in a partly fracture manner showing an embodiment in accordance with the present invention.
Figure 2:
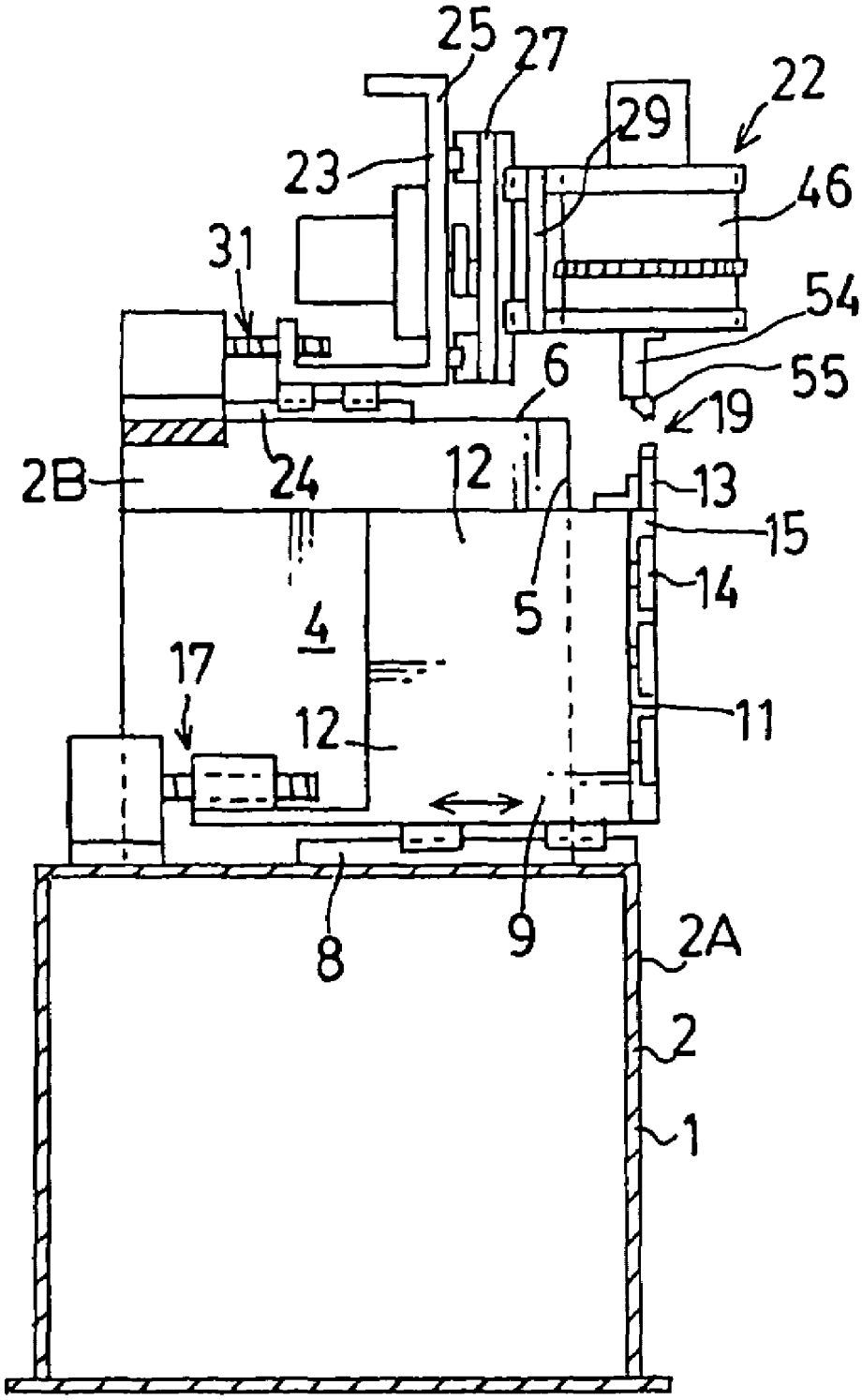
FIG. 2 is a cross sectional view along a line II—II in FIG. 1.
Figure 3:
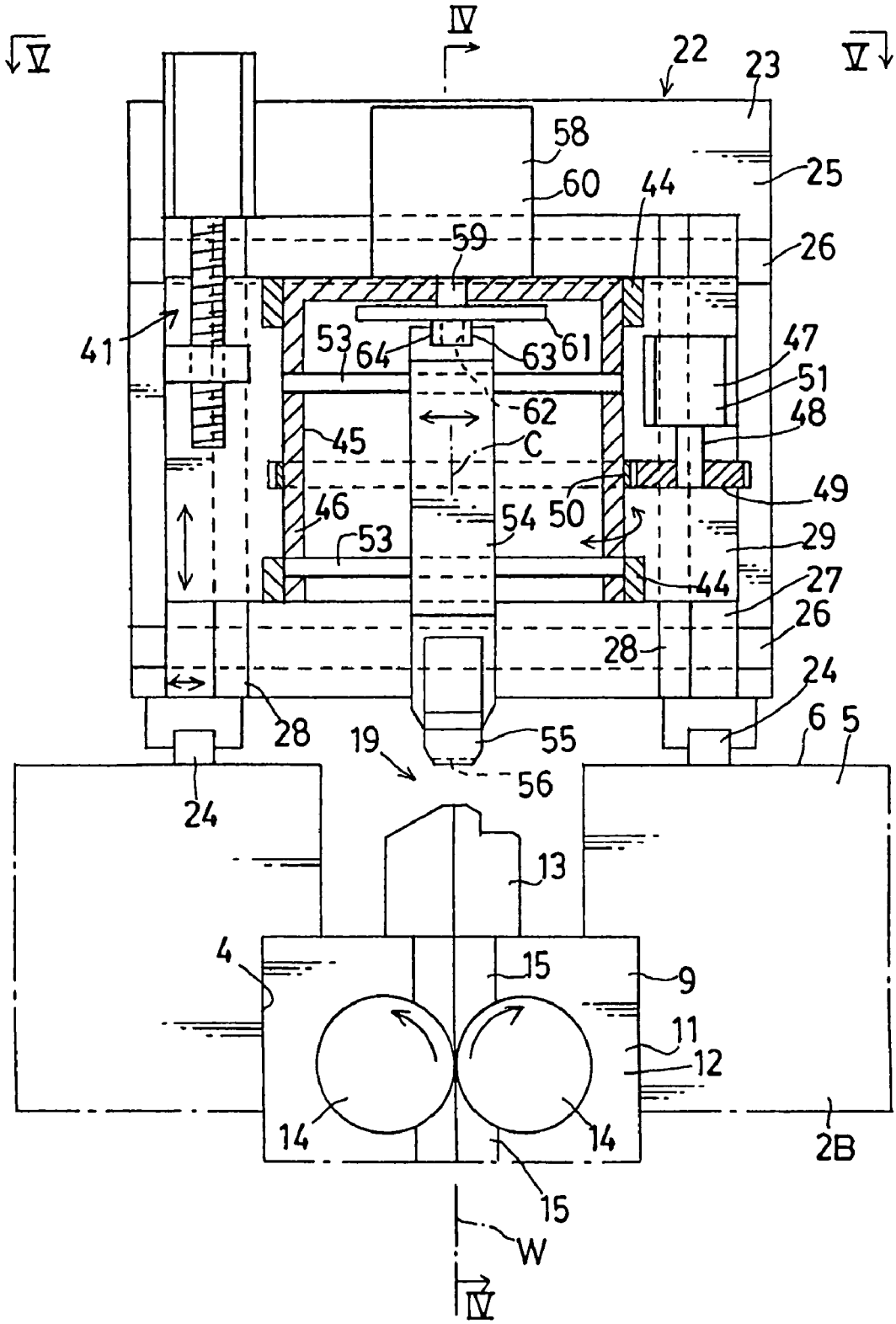
FIG. 3 is an enlarged view of a portion A in FIG. 1.
Figure 4:
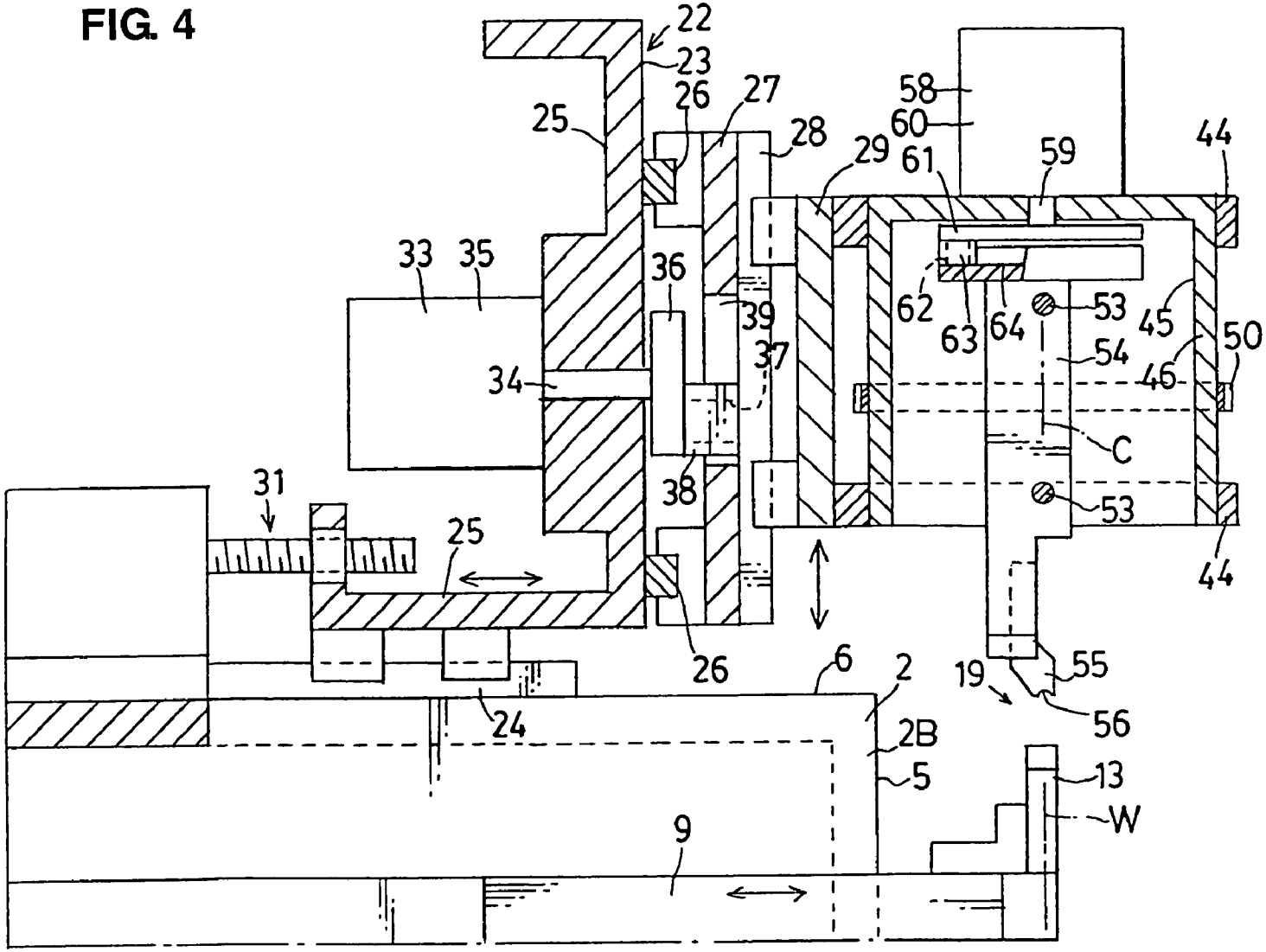
FIG. 4 is a cross sectional view along a line IV—IV in FIG. 3.
Figure 5:
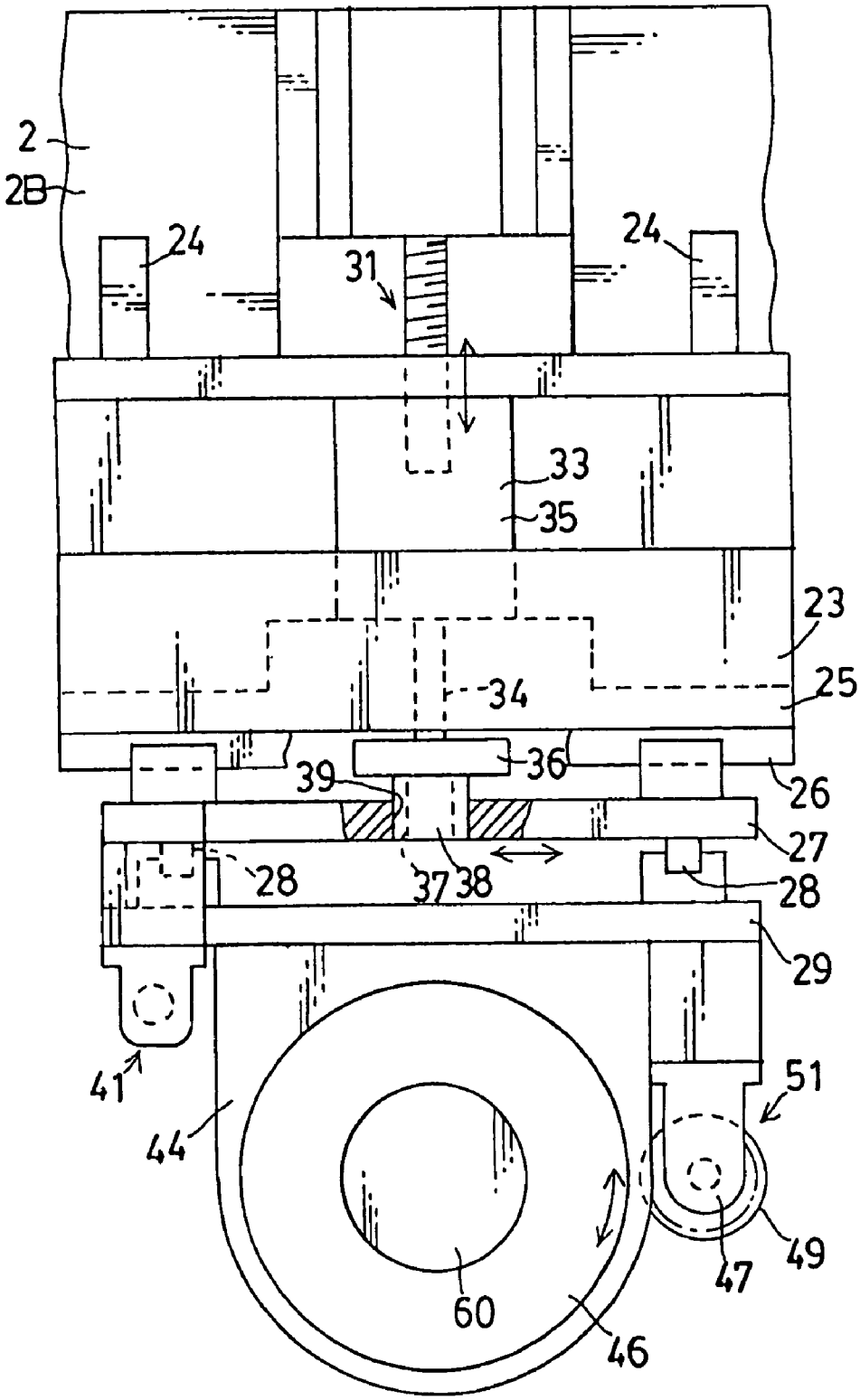
FIG. 5 is a cross sectional view along a line V—V in FIG. 3.

A description will be given below of an embodiment in accordance with the present invention.

In this case, in the following description, front indicates the top side on a paper surface in FIG. 1, rear indicates the back side thereof, left indicates the left side in FIG. 1, and right indicates the right side thereof.

A fixed machine casing 2 of a spring manufacturing machine 1 has a lower portion 2A and an upper portion 2B. The upper portion 2B has a recess portion 4 which is open to the front and rear sides and the upper side, at a middle portion in the right and left direction. A pair of right and left guide rails 8 having its longitudinal direction directed to the front and rear direction are provided on an upper wall of the lower portion 2A facing to the recess portion 4, and a wire rod delivering unit 9 fitted to the recess portion 4 is provided so as to freely move frontward and rearward along the guide rails 8.

The wire rod delivering unit 9 has a forward and backward moving body 12 constituted by a casing having a vertical front wall 11, a final wire rod guide 13 fixed to an upper portion of a front wall 11 of the forward and backward moving body 12, guiding the wire rod and including a wire rod passage (not shown) setting its center line W vertical (setting the wire rod passage parallel to the front wall 11), at least a pair of wire rod delivering rollers 14 rotatably provided to the front wall 11, and delivering the wire rod toward the final wire rod guide 13 while clamping the wire rod, and an auxiliary wire rod guide 15 provided to the front wall 11 so as to be positioned between the wire rod delivering rollers 14, and having a wire rod passage (not shown) setting its center line W vertical.

The forward and backward moving body 12 is structured such as to be moved frontward and rearward by a known driving apparatus 17 having a ball screw mechanism and a reverse rotatable motor. The wire rod delivering roller 14 rotates so as to deliver the wire rod toward the final wire rod guide 13 by driving of a known driving apparatus (not shown) provided within the forward and backward moving body 12.

The center line W of the final wire rod guide 13, the center line W of the wire rod passage (not shown) formed by annular grooves (not shown) of a pair of wire rod delivering rollers 14 which are brought into contact with each other, and the center line W of the wire rod passage (not shown) of the auxiliary wire rod guide 15 are provided so as to be arranged in alignment with each other.

A wire rod processing space 19 is formed above the final wire rod guide 13. A desired number of tool mounting slides 20 are provided on a vertical front wall 5 of the upper portion 2B so as to freely move forward and backward with respect to the wire rod processing space 19. The tool mounting slide 20 is structured such as to be operated by a known driving apparatus (not shown), and tools (not shown) such as a cutter, a forming tool and the like are mounted to the tool mounting slide 20.

A tool operating apparatus 22 is provided to the upper portion 2B of the fixed machine casing 2 in such a manner as to oppose to the final wire rod guide 13 beyond the wire rod processing space 19. The tool operating apparatus 22 is provided so as to freely move frontward and rearward with respect to the upper portion 2B, and has a position adjusting table 23 provided so as to move to an optional position within a virtual vertical surface which is in parallel to the front wall 5 of the upper portion 2B. The position adjusting table 23 has a first moving table 25 provided so as to freely move frontward and rearward with respect to a pair of right and left guide rails 24 arranged on the upper wall 6 of the upper portion 2B and having its longitudinal direction directed to the front and rear direction, a second moving table 27 provided so as to freely move rightward and leftward with respect to a pair of right and left guide rails 26 arranged on the first moving table 25 and having its longitudinal direction directed to the right and left direction, and a third moving table 29 provided so as to freely move upward and downward with respect to a pair of right and left guide rails 28 arranged on the second moving table 27 and having its longitudinal direction directed to the upward and downward direction.

The first moving table 25 is structured such as to be moved frontward and rearward by a known driving apparatus 31 having a ball screw mechanism and a reverse rotatable motor.

The second moving table 27 is structured such as to be moved rightward and leftward by a driving apparatus 33 mentioned in detail below. The driving apparatus 33 has a motor 35 having its axis directed to the frontward and rearward direction, having a reverse rotatable rotation shaft 34 and fixed to the first moving table 25, an eccentric pin 37 provided to the rotation shaft 34 via a disc 36 and having its axis directed to the frontward and rearward direction, a slider 38 rotatably fitted to the eccentric pin 37, and a long hole 39 to which the slider 38 is fitted with no play in the right and left direction, being long in the upward and downward direction, and formed in the second moving table 27. In accordance with the structure mentioned above, the second moving table 27 can be moved rightward and leftward by moving the position of the eccentric pin 37.

The third moving table 29 can be moved upward and downward by a known driving apparatus 41 having a ball screw mechanism and a reverse rotatable motor.

The third moving table 29 is provided with a pair of upper and lower bearings 44 in which their center lines C are set in parallel to the center line W of the wire rod passage (not shown) of the final wire rod guide 13, and a rotating body 46 having a recess portion 45 open downward is rotatably provided in the bearings 44. The rotating body 46 is structured such as to be rotated by a known driving apparatus 51. The driving apparatus 51 is constituted by a reverse rotatable motor 47 provided in the third moving table 29, a gear 49 fitted to a rotation shaft 48 of the motor 47, and an annular gear 50 provided on an outer peripheral surface of the rotating body 46 and engaged with the gear 49.

A pair of upper and lower guide rods 53, in which their axes are set horizontal and the axes are positioned on a virtual vertical plane including the rotation center line C, are mounted to the rotating body 46 in such a manner as to be positioned within the recess portion 45, and a tool mounting device 54 is guided by the guide rod 53 in such a manner as to freely move in parallel to a direction orthogonal to the rotation center line C of the rotating body 46 (freely move horizontally). A tool 55 (a bending die) is mounted to the tool mounting device 54, and a guide groove 56 is formed in a leading end of the tool 55 opposing to the final wire rod guide 13. At least a longitudinal center portion of the guide groove 56 is set in parallel to the moving direction of the tool mounting device 54. Further, the center line of the guide groove 56 along the longitudinal direction is set so as to be positioned within the virtual vertical plane including the rotation center line C.

The position adjusting table 23 operates to adjust the position so that the rotation center line C of the rotating body 46 is aligned with the center line W of the wire rod passage (not shown) of the final wire rod guide 13. Further, in the state mentioned above, the moving locus of the guide groove 56 in accordance with the horizontal movement of the tool mounting device 54 passes through the center line W.

The tool mounting device 54 is structured such as to be horizontally moved by a driving apparatus 58 which is in detail described below. The driving apparatus 58 has a motor 60 having an axis directed to the upward and downward direction, having a reverse rotatable rotation shaft 59 and fixed to the rotating body 46, an eccentric pin 62 provided in the rotation shaft 59 via a disc 61 and having an axis directed to the upward and downward direction, a slider 63 rotatably fitted to the eccentric pin 62, and a horizontally extending groove 64 to which the slider 63 is fitted with no play in the width direction, and which is formed in the tool mounting device 54. In accordance with the structure mentioned above, the tool mounting device 54 can be moved horizontally between a standby position apart from the final wire rod guide 13 and a working position close to the final wire rod guide 13, by moving the position of the eccentric pin 62.

The spring is manufactured by the spring manufacturing machine 1 in the same manner as the conventional one.

A description will be given below of a modified embodiment.

(1) The mechanism for moving the wire rod delivering unit 4 is optional.

(2) The number of the tool mounting slide 20 is optional.

(3) The spring manufacturing machine in which the center line W (C) is set horizontal by rotating the spring manufacturing machine 1 in the state in FIG. 1 in a clockwise direction or a counterclockwise direction is included in the spring manufacturing machine of the present invention.

(4) The position adjusting table 23 in accordance with the embodiment operates so as to make the position adjustment so as to align the rotation center line C of the rotating body 46 with the center line W of the wire rod passage (not shown) of the final wire rod guide 13. Accordingly, the structure can be made such that the first moving table 25 and the second moving table 27 are omitted by placing the third moving table 29 above the upper portion 2B in such a manner as to align the rotation center line C of the rotating body 46 with the center line W.

(5) The structure can be made such that any one of the wire rod delivering unit 9 or the position adjusting table 23 is not moved frontward and rearward.

What is claimed is:

1. A spring manufacturing machine which delivers a wire rod to a wire rod processing space from a final wire rod guide, and applies a predetermined process to the wire rod which was delivered or is being delivered to the wire rod processing space by a tool which is in a protruding or protruded state to the wire rod processing space so as to manufacture a spring, wherein a tool operating apparatus is provided in such a manner as to oppose to the final wire rod guide beyond the wire rod processing space, and the tool operating apparatus has a position adjusting table provided so as to freely move forward and backward with respect to the final wire rod guide, a rotating body provided so as to freely rotate around a rotation center line arranged in alignment with a center line of a wire rod passage of the final wire rod guide, to the position adjusting table, and a tool mounting device provided so as to freely move in parallel to a direction orthogonal to the rotation center line, in the rotating body.

2. A spring manufacturing machine which delivers a wire rod to a wire rod processing space from a final wire rod guide having a wire rod passage arranged in parallel to a vertical front wall of a fixed machine casing, and applies a predetermined process to the wire rod which was delivered or is being delivered to the wire rod processing space by a tool which is in a protruding or protruded state to the wire rod processing space so as to manufacture a spring, wherein a tool operating apparatus is provided in such a manner as to oppose to the final wire rod guide beyond the wire rod processing space, and the tool operating apparatus has a position adjusting table provided so as to freely move forward and backward and freely move to an optional position within a virtual vertical plane which is in parallel to the front wall of the fixed machine casing, a rotating body provided so as to freely rotate around a rotation center line arranged in parallel to a center line of the wire rod passage of the final wire rod guide, to the position adjusting table, and a tool mounting device provided so as to freely move in parallel to a direction orthogonal to the rotation center line, in the rotating body.

3. A spring manufacturing machine wherein a wire rod delivering unit is provided in such a manner as to freely move forward and backward, to a fixed machine casing having a vertical front wall, in front of which a wire rod processing space is formed, said wire rod delivering unit has a final wire rod guide having a forward and backward moving body including a vertical front wall and a wire rod passage for guiding the wire rod delivered toward the wire rod processing space, and provided on the front wall of the forward and backward moving body in such a manner as to make the wire rod passage parallel to the front wall of the forward and backward moving body, and at least a pair of wire rod delivering rollers rotatably provided on the front wall of the forward and backward moving body and delivering the wire rod toward the final wire rod guide while clamping the wire rod, a tool operating apparatus is provided to said fixed machine casing in such a manner as to oppose to the final wire rod guide beyond the wire rod processing space, and the tool operating apparatus has a position adjusting table provided so as to freely move to an optional position within a virtual vertical plane which is in parallel to the front wall of the fixed machine casing, a rotating body provided so as to freely rotate around a rotation center line arranged in parallel to a center line of the wire rod passage of the final wire rod guide, to the position adjusting table, and a tool mounting device provided so as to freely move in parallel to a direction orthogonal to the rotation center line, to the rotating body.

4. A spring manufacturing machine as claimed in claim 3, wherein said position adjusting table is provided so as to freely move forward and backward.

* * * * *